US007654275B2

(12) United States Patent
Ewell et al.

(10) Patent No.: US 7,654,275 B2
(45) Date of Patent: Feb. 2, 2010

(54) SAFETY CANE

(76) Inventors: Derek Marlow Ewell, 11349 NE. Glisan, Portland, OR (US) 97220; Jenny Diane Watters, 11349 NE. Glisan, Portland, OR (US) 97220

( * ) Notice: Subject to any disclaimer, the term of this patent is extended or adjusted under 35 U.S.C. 154(b) by 122 days.

(21) Appl. No.: 11/732,905

(22) Filed: Apr. 4, 2007

(65) Prior Publication Data

US 2008/0169011 A1 Jul. 17, 2008

Related U.S. Application Data

(60) Provisional application No. 60/789,463, filed on Apr. 5, 2006.

(51) Int. Cl.

| | |
|---|---|
| ***A45B 3/00*** | (2006.01) |
| ***A45B 9/02*** | (2006.01) |
| *E05F 5/02* | (2006.01) |
| *E05C 17/54* | (2006.01) |

(52) U.S. Cl. ..... 135/66; 135/76; 16/82

(58) Field of Classification Search ..... 135/66, 135/76, 65, 72; 292/338, 339; 16/82
See application file for complete search history.

(56) References Cited

U.S. PATENT DOCUMENTS

| | | | | | |
|---|---|---|---|---|---|
| 786,755 | A * | 4/1905 | Grey | 135/66 |
| 790,653 | A * | 5/1905 | Notthoff | 254/39 |
| 1,244,928 | A * | 10/1917 | Walters | 135/73 |
| 1,304,394 | A * | 5/1919 | Shyer | 292/338 |
| 2,198,082 | A * | 4/1940 | Harty | 359/516 |
| 4,176,870 | A * | 12/1979 | Cracraft | 292/338 |
| 4,351,348 | A * | 9/1982 | Axton | 135/66 |
| 4,407,318 | A * | 10/1983 | Stuever | 135/66 |
| 5,482,070 | A * | 1/1996 | Kelly | 135/66 |
| 5,722,445 | A * | 3/1998 | Hae et al. | 135/65 |
| 5,752,535 | A * | 5/1998 | Sanders | 135/68 |
| 5,901,723 | A * | 5/1999 | Ames | 135/66 |
| 6,085,766 | A * | 7/2000 | Geary | 135/75 |
| 6,745,786 | B1 * | 6/2004 | Davis | 135/65 |
| 6,772,778 | B2 * | 8/2004 | Morosini et al. | 135/65 |
| 6,933,855 | B2 * | 8/2005 | Preston | 340/825.19 |
| 6,957,750 | B1 * | 10/2005 | Trudell | 222/174 |
| 2002/0789657 | * | 12/2002 | Yuan | 135/65 |

* cited by examiner

*Primary Examiner*—David Dunn
*Assistant Examiner*—Tania Abraham
(74) *Attorney, Agent, or Firm*—Mark S. Hubert

(57) ABSTRACT

The present invention is a Cane/walking aid that provides the user with many security features along with mobility support. The cane/walking aid can be placed under the doorknob to secure the door(s) as a door-jamming device. The cane/walking aid will provide balance and mobility support. Life-saving medical alert information (identification, illnesses and medications) will be readily available inside the cane/walking aid. A safety alarm will sound if the user pulls the alarm string, which is to be wrapped around the user's wrist. This high-decibel alarm will also sound if the user becomes separated from the cane/walking aid. It also has a flashing safety light and a built in flashlight. The cane will have mace, an alarm, and/or other personal self-defense devices within. A G.P.S. device or a talking G.P.S. is provided for navigation. The cane/walking aid can accommodate an electronic insect repellent device.

10 Claims, 4 Drawing Sheets

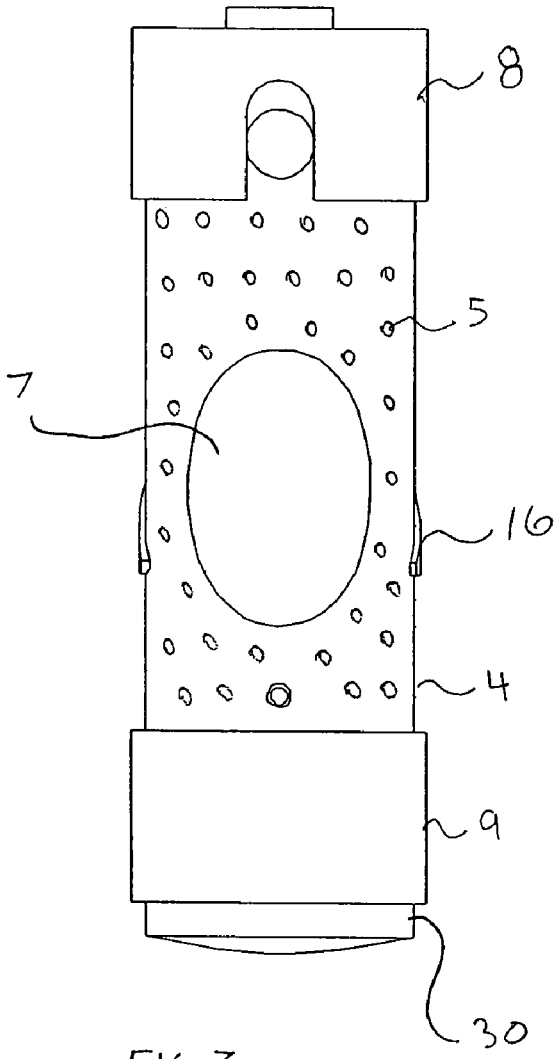
FIG. 3
FIG. 4
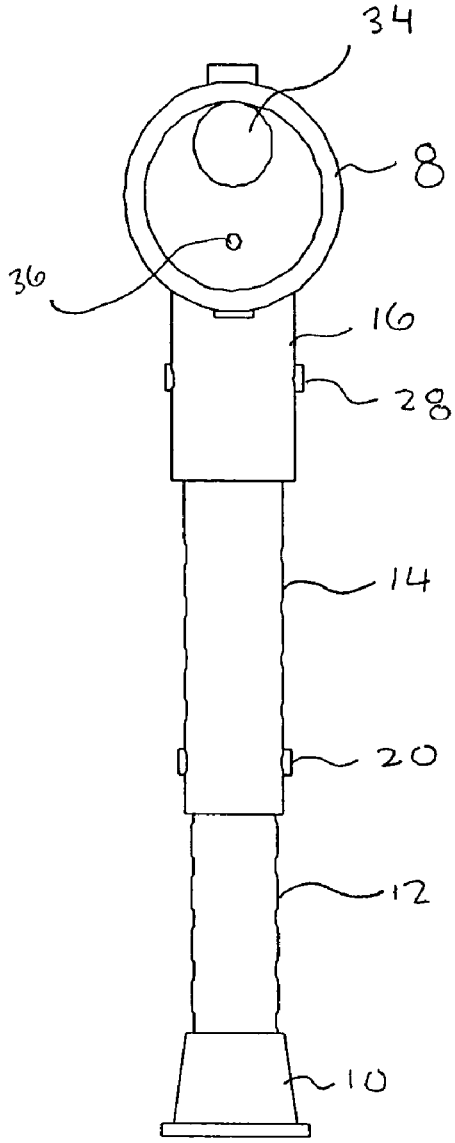

SAFETY CANE

This application claims under 35 U.S.C. 119, the right of priority and the benefit of earlier filing date of provisional application Ser. No. 60/789,463, filed Apr. 5, 2006 and incorporated herein by reference. Both this application and the provisional application have common inventors.

BACKGROUND OF THE INVENTION

The present invention relates to a novel and very useful cane/walking aid adapted to provide safety, convenience, and peace of mind for the user. More particularly, the cane/walking aid is designed to contain a flashlight, a high-decibel alarm, door-jamming device, mace, GPS, flashing red light, space for medical alert information storage, and other useful mobile technologies to afford safety and a feeling of security for the owner.

The American populace is aging. In the 2000 census, of the 281,421,906 population, 34,991,753 individuals were 65 and older or 12.4 percent of the population. High percentages of the aging population will become physically disabled and will need a cane/walking aid to compensate for leg, knee, foot, and hip impairment. According to the U.S. National Health Interview Survey, an estimated 7.4 million people use such devices for mobility limitations; 4.6 million for orthopedic impairments (including missing limbs); U.S. Government statistics state that the older population is growing and is expected to double by 2050 and the oldest old (those 85 and older) has grown nearly three times as fast as the overall population.

The safety cane has several functions. While the owner sleeps, the cane/walking aid can be placed under any doorknob either of two ways to secure the door as a door-jamming device. Later, when the owner leaves the residence the cane/walking aid will provide balance and mobility support. If the user becomes unconscious or unable to speak, life-saving medical alert information (identification, illnesses and medications) will be readily available inside the cane/walking aid for those trying to help. The safety alarm will sound if the user pulls the alarm string, which is to be wrapped around the user's wrist. This high-decibel alarm will also sound if the user becomes separated from the cane/walking aid. When it becomes dark, the cane/walking aid user will have the peace of mind of being visible when the flashing safety light is activated. Also, the built in flashlight will light the user's way. If the user is bothered by a dog or unwanted person the user will have mace, the alarm, and/or other personal self-defense devices at their disposal. A G.P.S. device can also be contained inside the cane/walking aid to help locate the user if lost. The cane/walking aid can accommodate a talking G.P.S. to be used to navigate with which would be very useful for the visually impaired. Also the cane/walking aid can accommodate an electronic insect repellent device.

No known cane/walking aid currently provides all of these safety/security functions. Most canes simply provide walking support and a few provide light. The need for mobility and independence is a basic human need and presents itself in many settings of weather, daylight and darkness. This new novel cane/walking aid truly supports full mobility and security to those who need it.

Henceforth, a safety cane would fulfill a long felt need in the aging and disability population. This new invention utilizes and combines known and new technologies in a unique and novel configuration to overcome the aforementioned problems and fulfill the need for increased mobility, independence, safety, and a sense of security.

SUMMARY OF THE INVENTION

The general purpose of the present invention, which will be described subsequently in greater detail, is to provide increased security, peace of mind and independence, while also providing mobility support. The cane/walking aid has many of the advantages mentioned heretofore and many novel features that result in a new cane/walking aid which is not anticipated, rendered obvious, suggested, or even implied by any of the prior art, either alone or in any combination thereof.

In accordance with the invention, an object of the present invention is to provide an improved mobility experience capable of offering personal safety/self defense through the mechanisms of a high-decibel alarm, mace, flashlight, and flashing/reflector red light.

It is another object of this invention to provide an improved cane/walking aid that can also be used for home security as a duo style, door-jamming device capable of meeting or exceeding the usual and expected functions of a typical cane/walking aid.

It is a further object of this invention to provide critical safety information in the form of medical alert ID, medications and illnesses of the user.

It is still a further object of this invention to provide for a GPS device for locating a user who is lost and/or assist the user with improved navigation.

It is also a further object of this invention to provide a electronic insect repellent specifically to repel mosquitoes.

It is yet a further object of this invention to provide a an improved mobility experience by providing increased safety and security devices incorporated into the cane/walking aid, which will in turn provide an increased sense of security, peace of mind and independence, particularly for some of the most vulnerable: the aging and disabled populations.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 3 is an top view of the safety cane;

FIG. 4 is a front end view of the safety cane;

DETAILED DESCRIPTION

Figure 1:
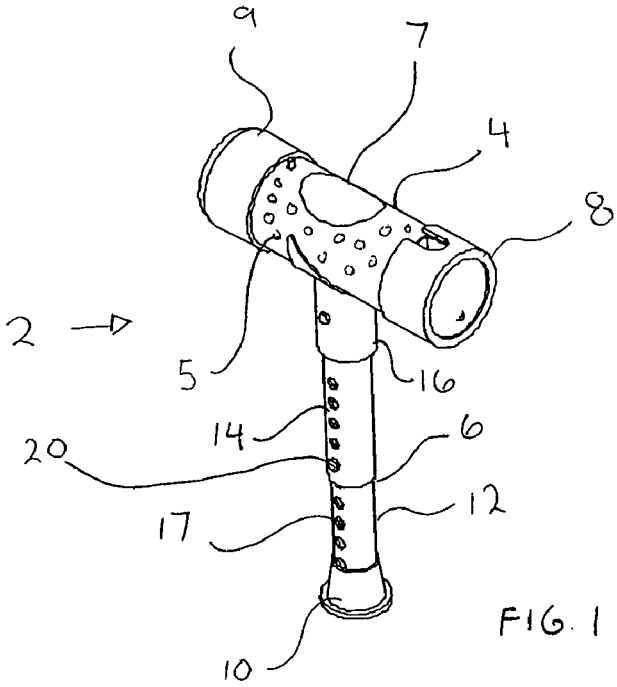
FIG. 1 is a perspective view of the safety cane.
Figure 5:
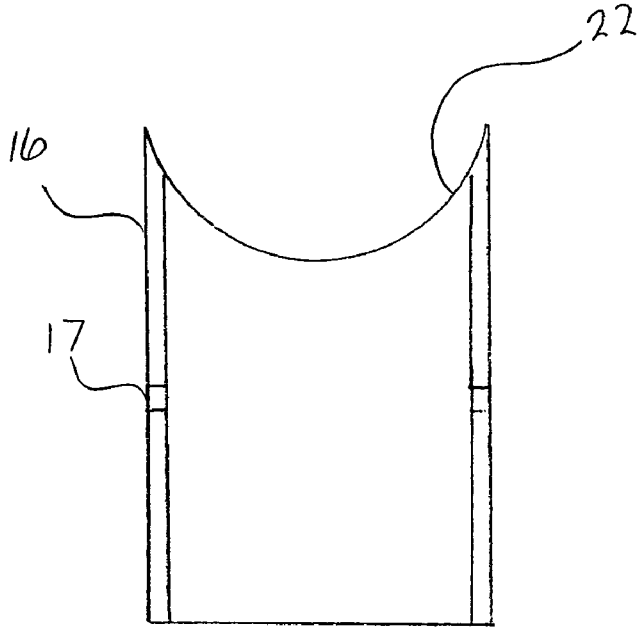
FIG. 5 is a cross sectional view of the concave connector.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Looking at FIG. 1 it can be seen that the safety cane 2 has a hollow, perforated head 4 with a plethora of orifices 5 therethrough and a concave saddle 7 formed on it's topmost surface. A first, removable, flexible, resilient sealing cap 8 frictionally engages the outer surface at the proximate end of the head 4, and a second, flexible resilient, removable sealing cap 9 frictionally engages the outer surface at the distal end of the head 4. An extendable shaft 6 extends normally from the head 4, centered at the approximate longitudinal midpoint of the head 4. The bottom end of the shaft has a flexible, grippable tip 10 frictionally engaged over the outer surface of the bottom end.

The shaft 6 has a inner, lower member 12 that fits inside the outer middle member 14. Both members have a linear series of equally spaced penetrations 17 formed through their hollow tubular bodies that when aligned, allow for the insertion of a first spring button 20 through the aligned penetrations 17 of both the members so as to lock the shaft lower member 12 and middle member 14 in a desired length. Such spring buttons that reside inside multi piece hollow tubular body assemblies of linearly extendable members are well known in the art.

Figure 2:
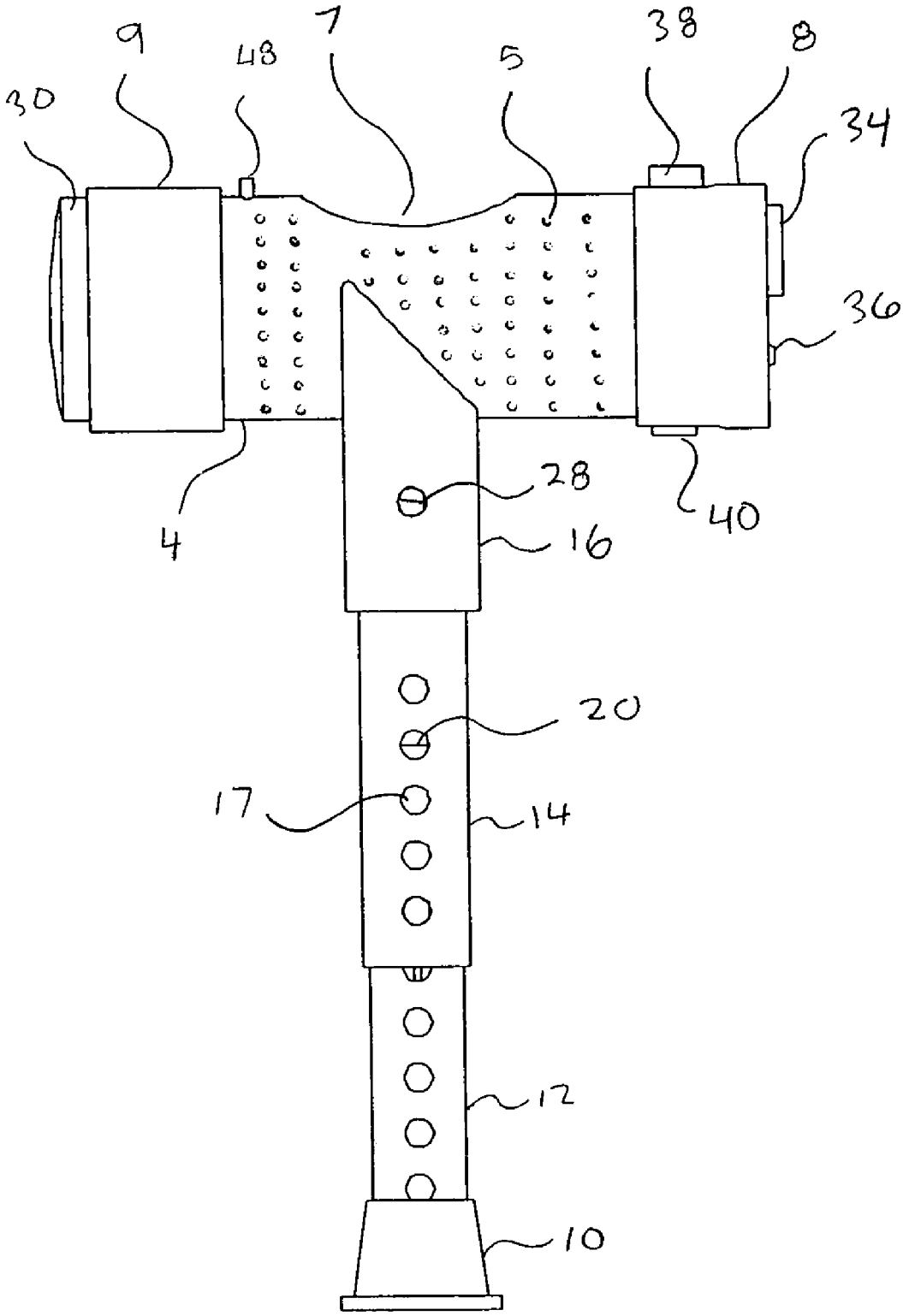
FIG. 2 is a side view of the safety cane.
Figure 6:
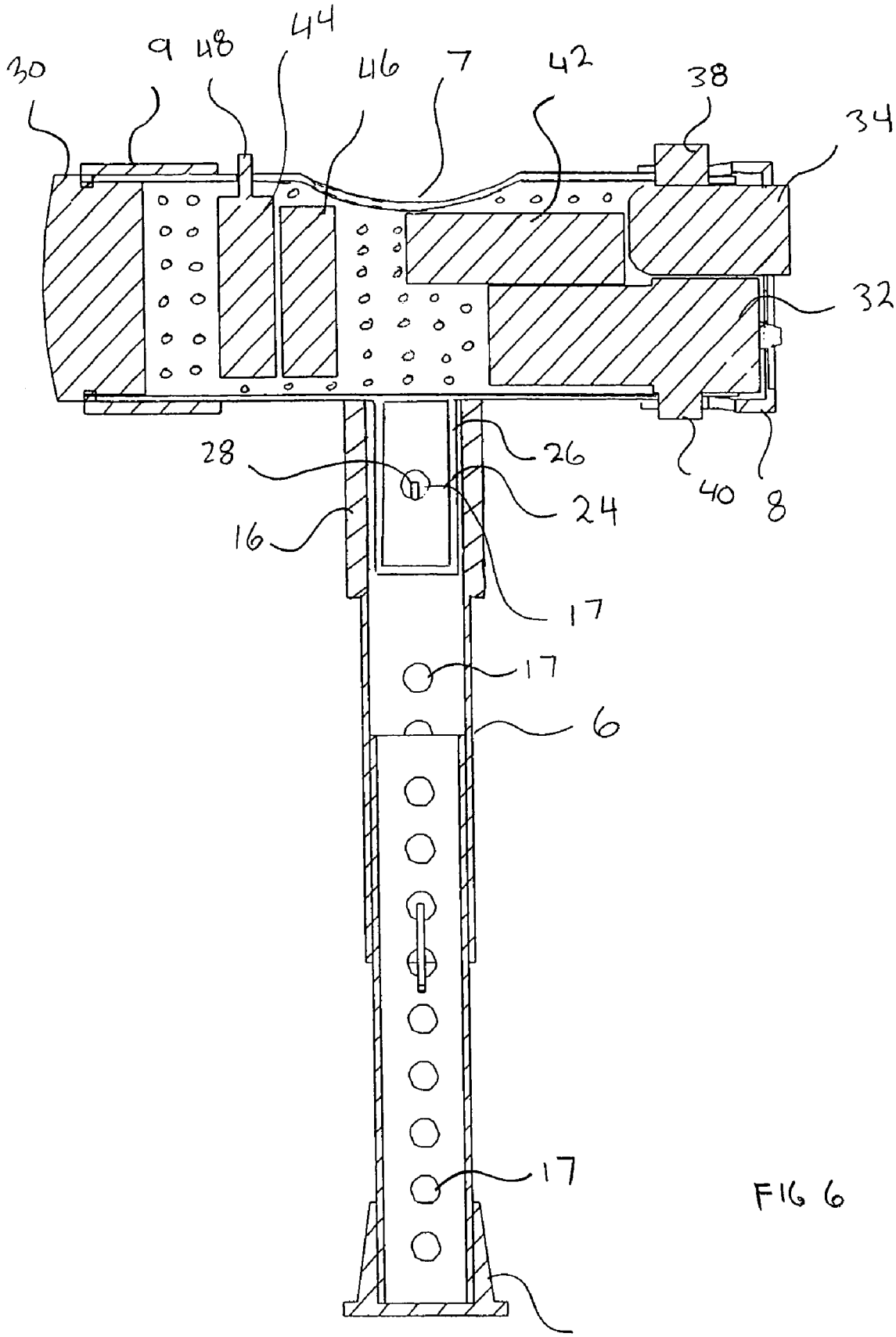
FIG. 6 is a cross sectional side view of the safety cane.

Looking at FIGS. 2 and 6 it can be seen that at the top end of the shaft 6, an upper member 16 having a semi-cylindrical, angled contour 22 cut into its uppermost end, is affixed normally to the head 4 by the insertion of the head stub shaft 24 into the internal recess 26 of the upper member 16. The uppermost point of the angled contour 22 extends to the approximate linear midpoint of the head 4, thereby allowing for the removal of the extendable shaft 6. A second spring button 28 extends normally from the stub shaft 34 and locks the stub shaft 24 to the upper member 16 through penetration 17 in a similar fashion to the locking of the shaft lower member 12 and middle member 14 to a desired length as discussed above.

In a door jamming operation, the concave saddle 7 of the head 4 of the safety cane 2 may be abutted adjacent to the bottom side of a conventional door knob and the shaft 6 extended such that the tip 10 reaches the floor while the linear axis of the shaft resides at an acute angle with the linear axis of the door. Where non conventional door handles are used, the head 4 may be removed from the shaft 6 by depressing the second spring button 28 and extracting the stub shaft 24, thereby exposing the angled contour 22 of the upper member 16, which may be jammed under the door handle with the shaft 6 adjusted and placed substantially similar to that discussed above. The upper member's angled contour 22 is approximately 1½" in length and approximately 2¼" wide between the two prongs. This has been found suitable to accommodate a wide variety of door handles.

The head 4 internally houses several safety and convenience related articles. These are best explained by viewing FIGS. 3, 4, and 6 collectively. The interior of the head 4 houses a colored reflector 30, frictionally constrained by the second cap 9 at the distal end; a mace (or equivalent) spray canister 32 and a flashlight 34 constrained at the first cap 8 at the proximate end such that the mace canister spray tip 36 and release button 40 as well as the flashlight switch 38 and flashlight 34 extend partially therethrough the first cap 8; a portable GPS device 42; an audible alarm device 44 and a electronic insect repeller 46 such that the alarm enabling mechanism 48 extends through one of the perforations 5 in the head 4.

With this configuration there is ample room remaining in the head 4 for the storage of medicine, documents, MP3 devices, knives, alert bracelets, whistles, pens, sunglasses, lotion, contacts and a plethora of other owner selected safety and convenience articles.

The cane may be illuminated at night, used to send audible distress signals, used to defend oneself via pepper or mace spray, used to reflect approaching cars light back, used to deter insects, used to navigate via audible GPS signals and of course to steady the walker. Other items may be added to the cane handle tube that will enhance the personal safety of the user because of the advancement of micro-technology, which is likely to allow for increasingly smaller safety devices to be used within the head 4. This coupled with the duo door jamming capabilities make this an indispensable aid for all.

The materials of the safety cane's construction will be lightweight yet strong and will encompass, aluminum, metal, and polymers. The head 4 is approximately two inches in diameter and six inches long. The first cap 8 and second cap 9 are approximately 2¼"×1⅜" and made of an appropriate material such as rubber, metal, or plastic, etc. The head 4 may be transparent, or opaque having a viewing window. The concave saddle 7 is approximately 2" long×1¼" wide and may also have a soft rubber or rubber-like gripping surface. This beveled or recessed section is designed to grip under a doorknob to effectuate the door jamming function of the safety cane 2. When using the safety cane as a walking aid, the user can also rest his/her hand in this recessed area.

Since the safety cane head 4 is removable this allows for user flexibility with the arrangement of the numerous components to be placed inside. Removing the head 4 will also allow the user to utilize the cane 2 itself as a door jammer and to be able to use the internal components separately.

Note, that while the alarm enabling mechanism 48 is depicted as a button it is known that such devices commonly use a string attached to a releasable alarm pin. In such cases, the string may be secured around the walker's wrist, while walking with the safety cane 2. This allows the user to easily activate the alarm 44 if necessary. If the user loops the string snugly around the wrist (recommended), the alarm can be activated if the user falls or is in some way separated from the cane 2.

The GPS device 42 may be used to locate the user of the safety cane 2 if they become lost. This is especially useful for elderly or mentally disabled safety cane users who may become disoriented. Another optional GPS device would allow the user to hear verbal directions as they navigate with the safety cane.

A blank card such as a business card or smaller will be provided to the user for medical alert information such as illnesses or medications and identifying information. The card can easily be placed inside the head 4 and can be viewed through a transparent head 4 by anyone who is trying to assist the user of the safety cane 2.

All components located within said cane head 4 may be physically secured in place through the use of simple mechanical stops. Since these will vary with the user's choice of components these stops are simple polymer tabs that may be glued to the inner surface of the hollow cane head 4. These are well known in the art and of numerous configurations, and as such have not been illustrated, although the commonest form would be a "T" formed from the normal intersection of a curved plate and a planar plate.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Any dimensions disclosed herein are not meant to be limiting but merely to demonstrate the preferred embodiment dimensions. Although shown as a round tubular design, it can be of square, rectangular, oval or other geometric configuration. The material of construction may be a polymer, steel or metal and may be varied as required by the desired resilience and weight.

The invention claimed is:

1. A height adjustable walking cane consisting of:

a segmented telescoping hollow tubular cane body with a top and bottom end;

a hollow door jamming cylinder removably affixed to said cane top end such that a longitudinal axis of said door jamming cylinder will reside normal to a longitudinal axis of said cane body and wherein said door jamming cylinder has a concave, oval depression formed on it's outermost top surface, at an approximate midpoint of said cylinder, and wherein said depression has a soft grippable surface thereon;

at least two removable caps adapted for enclosure of said door jamming cylinder; and a resilient tip frictionally affixed to said cane body's bottom end;

wherein said cane body has formed at said top end, a set of semi-cylindrical door jamming prongs having a spacing between prongs of approximately two and one quarter inches so as to be adapted to cradle a door handle shaft, having an internal recess and an angled contour cut along a longitudinal axis of said door jamming prongs, where said door jamming prong contour is matingly conformed to an outer surface of said door jamming cylinder, and wherein said door jamming cylinder has a stub shaft extending normally therefrom at an approximate midpoint of said door jamming cylinder, and wherein said door jamming cylinder is affixed to said cane top end by insertion of said stub shaft into said recess in said door jamming prongs.

2. The cane of claim 1 wherein said segmented telescoping hollow tubular cane body has a first shaft having an insertion end thereon and said bottom end thereon and a second shaft having a receiving end thereon and said top end formed thereon, and wherein said first shaft and said second shaft have linear groupings of orifices extending through said first shaft and said second shaft that are alignable when said insertable end of said first shaft is slidingly engaged within said receiving end of said second shaft.

3. The cane of claim 2 wherein said cane body top end has a recess therethrough, and said stub shaft has spring actuated detent that frictionally engages said recess to adjoin said door jamming cylinder and said cane body.

4. The cane of claim 3 wherein said cane cylinder is transparent and has a series of sound emission perforations formed therethrough an outer surface of said cylinder.

5. The cane of claim 4 further comprising a grippable substrate affixed to said depression.

6. The cane of claim 5 further comprising:

a flashlight;

a pepper spray canister;

a light reflective plate;

wherein said flashlight is mechanically constrained within said cylinder by frictional engagement of said flashlight through a first opening therethrough a first removable cane cylinder cap, and wherein said pepper spray is mechanically constrained within said cylinder by frictional engagement of said spray canister through a second opening therethrough a first removable cane cylinder cap, and wherein said light reflective plate is mechanically constrained within said cylinder by frictional engagement of said plate through an opening therethrough a second removable cane cylinder cap.

7. The cane of claim 6 further comprising a GPS device mechanically secured within said cane cylinder.

8. The cane of claim 7 further comprising an electronic insect repellant device mechanically secured within said cane cylinder.

9. The cane of claim 8 further comprising a user actuated audible alarm device mechanically secured within said cane cylinder.

10. The cane of claim 9 wherein said cylinder has a flashlight button orifice formed therethrough, a mace actuator button recess formed therethrough, and an audible alarm actuator recess formed therethrough.

* * * * *